United States Patent [19]

Pearl

[11] 3,991,706

[45] Nov. 16, 1976

[54] MARKING APPARATUS UTILIZING A DYE THREAD

[75] Inventor: David R. Pearl, West Hartford, Conn.

[73] Assignee: Gerber Garment Technology, Inc., East Hartford, Conn.

[22] Filed: Jan. 20, 1976

[21] Appl. No.: 650,791

[52] U.S. Cl. ..... 118/7; 118/38

[51] Int. Cl.[2] ..... B05C 11/00

[58] Field of Search ..... 118/35–42, 118/7, 401, 76–78; 33/189; 101/26; 427/256, 289, 293

[56] References Cited

UNITED STATES PATENTS

| | | | |
|---|---|---|---|
| 2,347,333 | 4/1944 | Phillips | 101/26 |
| 2,557,668 | 6/1951 | Lincoln | 118/35 X |
| 3,312,562 | 4/1967 | Miller | 118/38 X |
| 3,731,648 | 5/1973 | Gerber et al. | 118/7 X |

FOREIGN PATENTS OR APPLICATIONS

| | | | |
|---|---|---|---|
| 104,641 | 6/1942 | Sweden | 33/189 |

*Primary Examiner*—Morris Kaplan

*Attorney, Agent, or Firm*—McCormick, Paulding & Huber

[57] ABSTRACT

An automatically controlled cutting machine having a support table on which limp sheet material is spread for cutting by means of a cutting tool is provided with a marking apparatus to identify key points on pattern pieces cut from the sheet material. The cutting tool and the marking apparatus are mounted on a tool platform for movement to any desired location over the sheet material. The marking apparatus utilizes a needle which is suspended above the sheet material and a dye thread which is laced through an eyelet in the depending end of the needle. Each time a mark is to be generated, the needle plunges downwardly through the sheet material, and dye on the thread is rubbed onto the material at the point under consideration. An indexing mechanism operated with the reciprocating movement of the needle pulls a finite length of thread through the eyelet after each marking operation.

9 Claims, 4 Drawing Figures

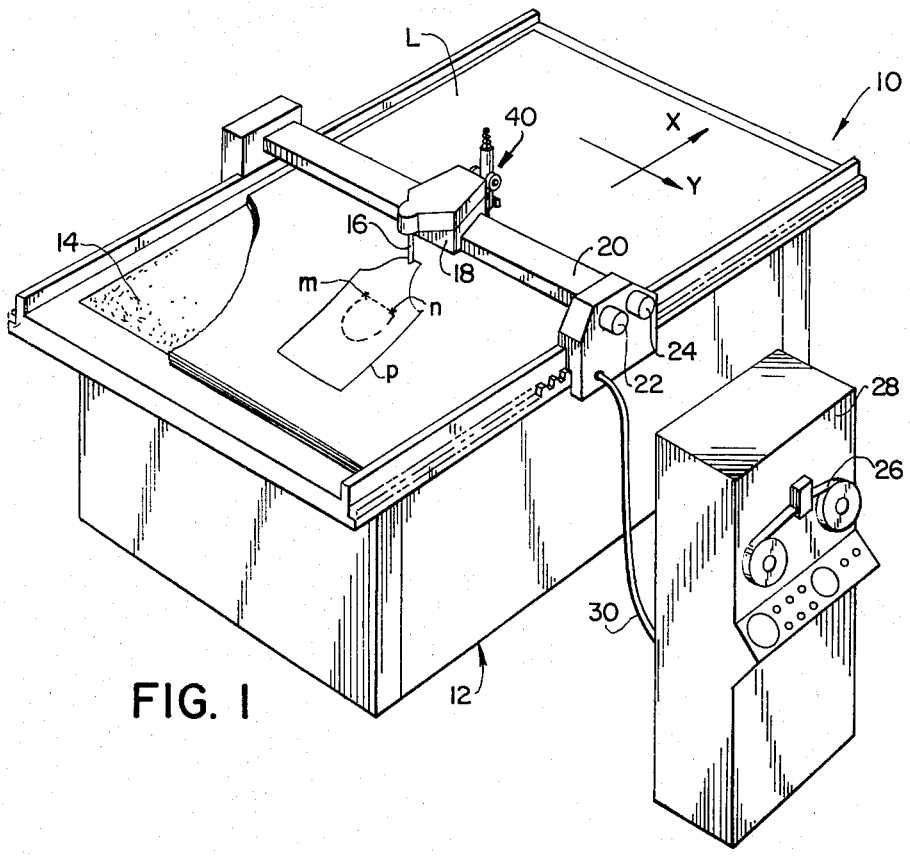
FIG. 1
FIG. 4
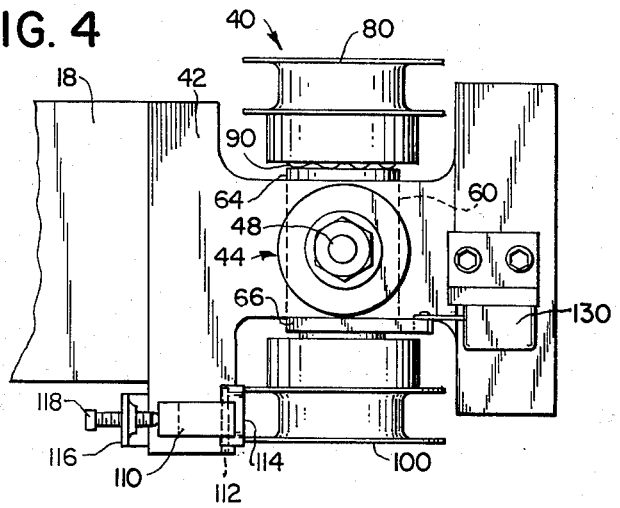

MARKING APPARATUS UTILIZING A DYE THREAD

BACKGROUND OF THE INVENTION

The present invention relates to apparatus for marking limp sheet material such as woven or nonwoven fabrics utilized in manufacturing garments, upholstery, and similar articles. More particularly, the invention relates to a marking apparatus that utilizes a thread having a dye thereon or impregnated therein so that drawing thread through the fabric material produces a mark for later identifying a key location on the material.

It has been common practice in the garment manufacturing industry to cut pattern pieces for clothing, upholstery, and the like from a multi-ply layup of fabric material. More recently, numerically controlled cutting mechines such as disclosed in U.S. Pat. No. 3,495,492 issued to the assignee of the present invention have been developed to cut pattern pieces with savings in time, increased accuracy and reduced waste material. The cut pattern pieces are then removed from the cutting machine and are taken to a sewing room where the various pieces are assembled as finished articles.

In assembling the various pattern pieces, certain key points such as the corners of pockets, intersections of seams, the location of buttonholes or shaping seams and similar points of interest within the contours of the pattern pieces are important.

Manual marking of the key points within pattern pieces has been done in the past by lacing colored thread through a stack of identical pattern pieces at the point of interest and then snipping a short segment of the thread with each pattern piece removed from the stack so that the thread remains with the pattern piece at a key point until the sewing operation associated with the point is begun. In other forms of thread marking, a dye such as a fluorescent dye, is applied to the thread and the thread is worked manually back and forth through the stack of pattern pieces at a key point to rub the dye onto the material and develop a mark. Such dye is later washed out or otherwise removed from the finished article.

With the advent of automatically controlled cutting machines, it readily became apparent that the marking operation could be performed by the same basic machine which performs the cutting operation under numerical control. U.S. Pat. Nos. 3,548,502 and 3,731,648 both disclose numerically controlled apparatus adapted for such marking functions. In the latter Pat. No. 3,731,648 having the same assignee as the present invention, a hollow needle is plunged through the stack of pattern pieces and a flowable marking material is deposited throughout the stack as the needle is withdrawn. When individual pattern pieces are removed from the stack, a small quantity of the marking material adheres to the pattern pieces at the points of interest. The marking of fabric material by means of a dye thread, however, has the advantage of producing a mark which can be brushed or washed off or otherwise removed from the material without great difficulty after the garment or upholstery is assembled. Thus, it is desirable to adapt an automatically controlled machine to utilize a needle which penetrates a dye thread through the stack of pattern pieces at points of interest. U.S. Pat. No. 3,765,349 discloses an apparatus for inserting thread through a stack of pattern pieces but not for the purpose of marking.

It is accordingly, a general object of the present invention to provide a marking apparatus which may be utilized on an automatically controlled cutting machine and which is adapted to plunge dye thread through a stack of pattern pieces at points of interest.

SUMMARY OF THE INVENTION

The present invention resides in an apparatus utilizing a dye thread for marking fabric material at key points for future reference. The type of dye thread may vary but in one common form a fluorescent dye is deposited or impregnated in the thread and is rubbed off on the fabric material to produce a visible mark when the fabric is viewed under a fluorescent light.

The apparatus comprises an actuator having a stationary member and a movable member which reciprocates relative to the stationary member. For example, a pneumatic piston and cylinder assembly in which the piston rod reciprocates in and out of the cylinder is utilized in a preferred embodiment of the invention. A needle having an eyelet at one end is connected at the opposite end with the movable member for reciprocation in and out of a fabric material with a dye thread laced through the eyelet. The reciprocating motion causes the dye to be rubbed off on the fabric material and leave an identifying mark.

A thread supply spool and a thread takeup spool are positioned in fixed relationship with one of the actuator members and are rotatably mounted to respectively feed the dye thread to the eyelet of the needle and draw the dye thread from the eyelet of the needle. Means are provided for rotating the takeup spool by a finite amount only in the takeup direction so that a fresh section of dye thread is pulled between the supply spool and the takeup spool through the eyelet of the needle. Preferably, the means for rotating is operated with each reciprocation of the actuating member and needle so that a distinct and clear mark is always generated.

In one embodiment of the invention, the means for rotating includes a linear member which remains stationary while the takeup spool reciprocates with the needle. The periphery of the spool and the linear member are placed in tangential engagement so that rotation of the spool is produced. A one-way clutch prevents rotation of the spool in the direction opposite the takeup direction and, therefore, the actuator which reciprocates the needle also serves as the motor for drawing the dye thread through the needle by a finite amount with each reciprocation.

BRIEF DESCRIPTION OF THE DRAWINGS

FIG. 1 is a perspective view of an automatically controlled cutting machine in which the marking apparatus of the present invention is installed.

FIG. 4 is a top plan view of the marking apparatus in FIG. 2.

DESCRIPTION OF THE PREFERRED EMBODIMENT

Figure 3:
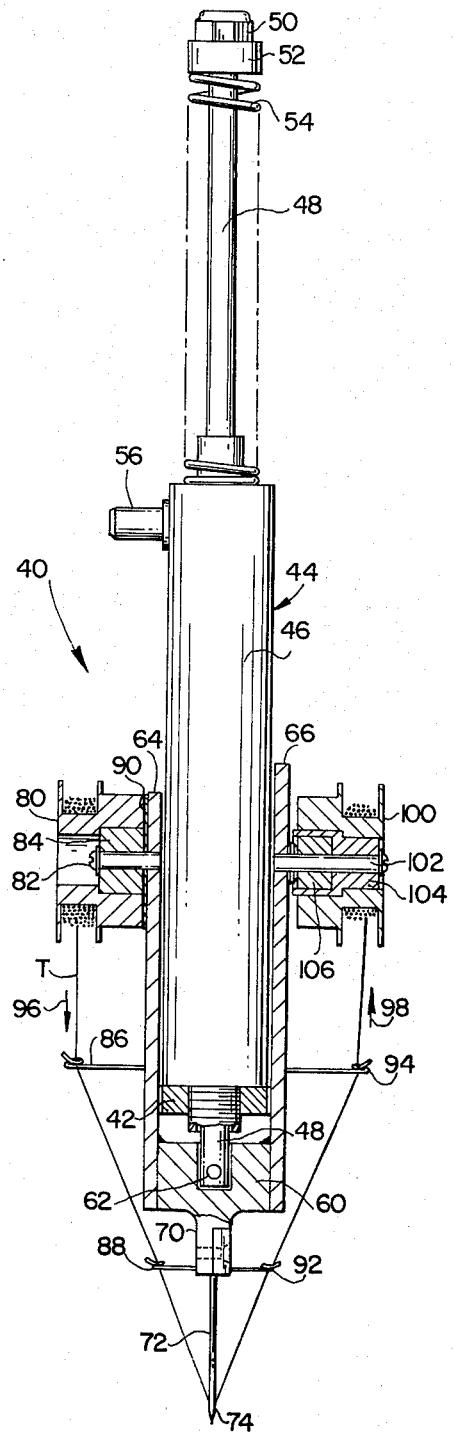
FIG. 3 is an enlarged sectional view of the marking apparatus as viewed along the sectioning line 3-3 in FIG. 2.

FIG. 1 illustrates an automatically controlled cutting machine generally designated 10 of the type described in greater detail in U.S. Pat. No. 3,955,458 . Such a machine includes a cutting table 12 having a penetrable support bed 14 defining a support surface on which a multi-ply layup L of limp sheet material is spread during a cutting operation. The bed 14 in one form is comprised of a plurality of bristled mats positioned in side-by-side relationship with the free ends of the bristles defining the support surface on which the material is placed. A vacuum system associated with the bed evacuates the layup to compress the multiple plies and holds the layup in fixed position on the table as the cutting operation progresses.

A cutting tool taking the form of a reciprocating knife blade 16 is suspended from a tool platform or carriage 18 above the layup L and, during cutting, reciprocates through the layup and into the penetrable bed 14. The carriage 18 is mounted to move laterally across the table 12 in the illustrated Y-coordinate direction on the cross beam of another carriage 20. The carriage 20 travels longitudinally over the table in the X-coordinate direction so that the blade 16 can be moved to any desired location over the table. In addition, the blade is rotated about its vertical axis so that by means of the combined motions of the blade and the carriages, the blade can be moved tangentially along a cutting path P and cut a stack of similarly shaped pattern pieces from the layup.

The motions of the carriages 18 and 20 are produced by servo drive motors 22 and 24 respectively. The motions of the blade and carriages are defined on a program tape 26 and are read and converted into servomotor command signals by means of a numerical controller 28 connected to the cutting table by means of the command signal cable 30.

Turning more particularly to the present invention, let it be assumed that the pattern piece defined by the cutting path P in FIG. 1 represents the left front panel of a shirt and that a pocket is to be located as shown in phantom on the finished article. The key identification points *m* and *n* completely define the location of the pocket. Since the points *m* and *n* have a known positional relationship with the cutting path P, it is readily possible to identify these points in the program tape 26 so that a marking apparatus mounted on the tool platform 18 can perform the marking function before the stack of cut pattern pieces is removed from the cutting table. The marking operation may either precede or follow the cutting operation.

Accordingly, a marking apparatus 40 is attached to the tool platform 18 at one side of the platform opposite the knife blade 16. Although this positioning of the apparatus 40 establishes a fixed offset of the control axes for the cutting tool and the marking tool, such offset can be compensated for either within the controller 28 itself or in the program tape 26 so that the generation of marks identifying points *m* and *n* occurs at the correct locations within the pattern piece outlined by the cutting path P.

Figure 2:
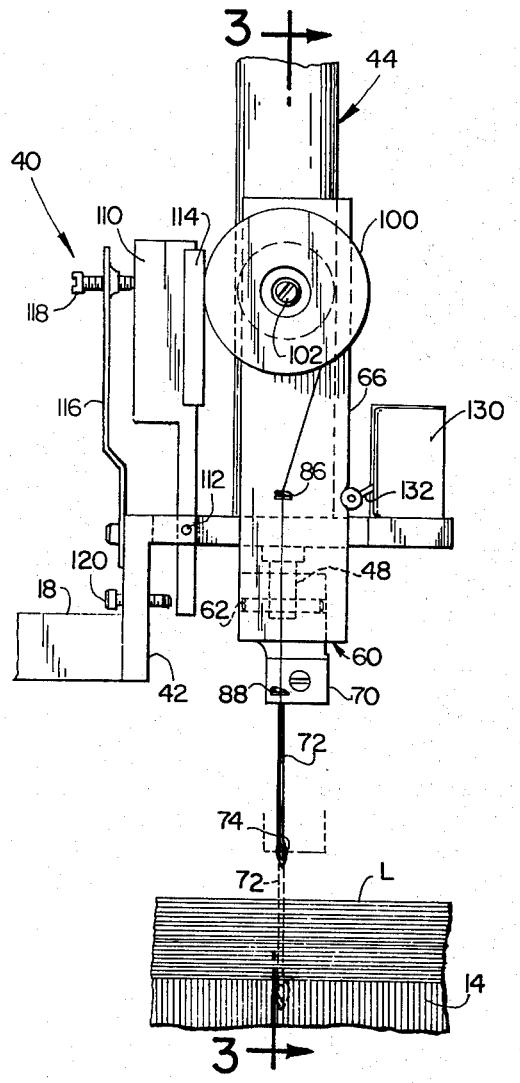
FIG. 2 is a side elevation view of the marking apparatus with the upper portion of the actuator cut away.

FIGS. 2-4 illustrate the marking apparatus 40 in detail. In FIG. 2 an L-shaped bracket 42 is connected as an extension to the tool platform 18 and serves as a mounting bracket for the remaining components of the marking apparatus. As viewed in FIG. 4 the bracket 42 has a generally H-shaped configuration and a reciprocating actuator comprised of a pneumatic piston and cylinder assembly 44 is mounted near the center of the H-shape. The assembly 44 includes a cylinder 46, which is threadably connected to the bracket 42 as shown in FIG. 3, and a reciprocating piston rod 48 which extends through and projects from each end of the cylinder. The upper end of the piston rod 48 carries a locknut 50 and washer 52 and a compression spring 54 is mounted coaxially of the rod between the washer 52 and the upper end of cylinder 46. The spring 54 is in compression at all times and, therefore, urges the lower end of the piston rod 48 into a retracted position illustrated in FIG. 3. When compressed air or other gas is introduced to the cylinder 44 through a nipple 56 in the upper end of the cylinder 46, it operates internally on a piston (not visible) and displaces the lower end of the rod 48 downwardly to an extended position. When the pneumatic pressure is released, the compression spring 54 returns the piston rod to the retracted position.

A needle plunger 60 is connected to the depending end of the piston rod 48 by means of a press-fitted pin 62 extending through a channel in the plunger and a hole in the end of the piston rod. The plunger 60 includes two upright guide bars 64 and 66 which straddle the midsection of the bracket 42 and extend along diametrically opposite sides of the cylinder 46. Thus, the guide bars 64 and 66 together with the pin 62 hold the plunger 60 in a vertically oriented position parallel to the axis of the cylinder assembly 44 in the rest position and during reciprocation of the piston rod 48.

The lower end of the plunger 60 bears a needle clamp 70 in which an industrial sewing needle 72 is held coaxially of the piston rod 48. The needle has a thread eyelet 74 in its depending end as shown in FIG. 2. When the piston rod 48 is extended from the cylinder 46, the needle 72 is moved from the upper position to the lower phantom position illustrated in FIG. 2 and the depending end of the needle plunges downwardly through the stack of sheet material forming the layup L and partially into the penetrable bed 14 of the cutting table. When the piston rod thereafter is retracted and completes a reciprocation, the needle returns to the upper rest position in which the depending end is completely withdrawn from the layup L and the needle is thus free to move with the tool platform 18 horizontally over the cutting bed 14 on which the layup is held.

A thread supply spool 80 is rotatably mounted on the upper end of the guide bar 64 by means of a machine screw 82 and a bushing 84. The spool 80 is provided to store a quantity of the dye marking thread T and to feed the thread as indicated by the arrow 96 to the eyelet 74 of the needle through thread guides 86 and 88 on demand. A wave washer 90 or other friction drag device may be interposed between the spool 80 and the guide bar 64 to maintain a slight tension on the thread and correspondingly eliminate any slack in the thread as it is fed to the needle 72.

After passing through the eye of the needle 72, the thread passes upwardly through thread guides 92 and 94 and onto a takeup spool 100 as indicated by the arrow 98. The takeup spool 100 is mounted on the upper end of the guide bar 68 by means of the machine screw 102, a bushing 104, and a one-way clutch 106 interposed between the bushing and the screw 102. For reasons to be explained below, the one-way clutch serves as a means for preventing the spool 100 from rotating in a direction opposite the takeup direction, that is, the direction opposite that in which the spool rotates to draw the dye thread T onto the spool.

Means including the one-way clutch 106 are provided for indexing the thread a finite amount with each reciprocation of the needle 72 in and out of the layup L. Such means in the preferred embodiment of the invention comprises a linear drive bar 110 in FIGS. 2 and 4 pivotally mounted on the bracket 42 by means of a pin 112. The upper end of the bar 110 bears a strip of rubber 114 or other friction-producing element which is tangentially engaged with the cylindrical surfaces of flanges on the takeup spool 100. If desired either the strip 114 or the cylindrical surfaces of the flanges of the spool 100 or both may be provided with fine serrations to improve the engagement. The strip 114 is pressed into engagement with the spool flanges by means of a resilient leaf spring 116 mounted on the bracket 42 and a force adjustment screw 118 at the upper end of the spring. Advancing the screw toward the bar 110 increases the engagement force and retracting the screw reduces the force. An overtravel stop screw 120 limits the pivoting movement of the drive bar 110 when the spool 100 is removed.

In operation, the tool platform moves the marking apparatus 40 over the layup to a location which corresponds with the point *m* or *n* of interest as shown in FIG. 1. When the needle is correctly positioned above the point, air is supplied to the cylinder 46 and the piston 48 moves the needle plunger 60 and the needle 72 downward so that the eyelet 74 of the needle passes through the layup L. The dye thread laced through the eyelet of the needle is drawn through the layup at the point of interest and deposits a small quantity of the dye on each ply of the layup in the process. When air pressure within the cylinder 46 is released, the compression spring 54 raises the needle out of the layup and a small additional quantity of dye may be deposited on each ply of the layup. Several reciprocations at the same key point may be made to increase the intensity of the mark.

In one embodiment of the invention, the one-way clutch 106 prevents rotation of the spool 100 as the plunger 60 and the needle 72 move downwardly. Thus, the spool skids along the rubber strip 114 until it either disengages the lower end of the strip or the downward motion of the plunger stops. When the plunger reverses its movement in the upward direction, the one-way clutch releases, and engagement of the strip and the flanges of the spool causes rolling movement of the spool over the strip and rotates the spool in the takeup direction. A finite length of the dye thread is therefore drawn from the supply spool 80 through the thread guides 86, 88, the eyelet 74 of the needle 72 and the thread guides 92 and 94 onto the spool 100. The length of thread indexed or moved between the spools may be equal to or less than the length of thread pulled through the layup and may be controlled by the length of the rubber strip 114 on the drive bar 110 and the dimensions of the spool 100.

Thus, the relative movement produced between the stationary drive bar 110 and the reciprocated takeup spool 100 by the pneumatic actuator 44 is utilized to generate the rotational movement for indexing a fresh section of the dye thread between the spools.

As a safety measure, it is desirable to incorporate means for locking out the servomotors 22 and 24 in FIG. 1 whenever the marking apparatus is in operation. It will be understood that if the tool platform 18 was moved while the needle 72 was embedded in the layup, damage could result to the needle and other portions of the marking apparatus. To this end a safety switch 130 is mounted on the bracket 42 and has an actuating arm 132 which rests in a detent in the guide bar 66 when the piston rod 48 is retracted and the needle 72 is in its upper, rest position. However, when the plunger 60 is lowered, the actuating arm 132 moves out of the detent in the guide bar 66 and the switch 130 causes the command signal path to the servo motors 22 and 24 to be interrupted. Thus, the tool platform cannot move. When the plunger 60 is raised so that the actuating arm 132 falls back into the detent of guide bar 66, the switch 130 reestablishes the command signal path to the servo motors.

In summary, an apparatus has been disclosed for marking points of interest in fabrics and similar materials by means of a dye thread. The apparatus is advantageously employed for use with an automatically controlled cutting machine and utilizes a single actuator to reciprocate the needle carrying the thread through the fabric material and to index a fresh segment of thread through the needle with each reciprocation.

While the present invention has been described in a preferred embodiment, it should be understood that numerous modifications and substitutions can be made without departing from the spirit of the invention. For example, the needle 72 may have a longitudinal groove on one side to accommodate the thread, or the needle 72 may be replaced by a hollow needle through which the dye thread is either fed to or returned from an eyelet in the lower end. A double-acting actuator rather than the single-acting actuator 46 with a compression spring may be substituted; however, the single-acting actuator renders the marking apparatus fail safe since it returns the needle to the raised position upon a power failure. It should also be appreciated that by reversing the operation of the one-way clutch the takeup rotation of the takeup spool 100 may occur during the downstroke of the piston rod rather than during the upstroke as described in the preferred embodiment; however, it is important that the thread be completely indexed through the eyelet of the needle before the eyelet enters the fabric material otherwise the thread could break. The supply spool 80 and the takeup spool 100 may have the same configuration as shown in FIG. 3 so that the spools can be interchanged after all of the thread has been advanced onto the takeup spool. Thus, the dye thread which is relatively expensive, may be recycled through the needle numerous times until the dye is exhausted. Accordingly, the present invention has been described in a preferred embodiment by way of illustration rather than limitation.

I claim:

1. In combination with an automatically controlled cutting machine having a cutting tool mounted on a tool platform over a support surface on which sheet material is placed in a spread condition to permit the tool and material to move relative to one another and cut pattern pieces from the material, the improvement comprising:

a needle plunger mounted on the tool platform for reciprocation along an axis of the plunger toward and away from sheet material on the support surface;

a needle depending from the plunger along said axis for penetration through the sheet material when the plunger is reciprocated toward the support surface and having an eyelet in the depending needle end;

a supply spool rotatably mounted on the tool platform for feeding a marking thread to the eyelet of the needle;

a takeup spool also rotatably mounted on the tool platform for receiving marking thread from the eyelet of the needle;

actuating means connected with the needle plunger for reciprocating the plunger along the plunger axis and reciprocating the needle in and out of the sheet material; and indexing means connected with the takeup spool and operatively responsive to said actuating means reciprocating the plunger and needle for advancing a length of marking thread from the supply spool through the eyelet of the needle to the takeup spool.

2. The improvement of claim 1 wherein the actuating means is connected with and energizes the indexing means when the plunger is reciprocated.

3. The improvement of claim 1 wherein the indexing means is responsive to the actuating means to advance a length of thread with each reciprocation of the needle.

4. The improvement of claim 1 wherein:

the takeup spool is connected with the needle plunger for reciprocation with the needle; and the indexing means includes a drive member connected with the tool platform and positioned adjacent the plunger whereby the reciprocated takeup spool and the drive member move relative to one another during reciprocation of the needle, the drive member and spool being in tangential engagement to cause rotation of the spool during at least one portion of the relative movement.

5. The improvement of claim 4 wherein the indexing means further includes means for preventing rotation of the takeup spool in a direction opposite the takeup direction.

6. The improvement of claim 1 wherein:

both the supply spool and the takeup spool are mounted for rotation on the plunger for reciprocation with the needle; and the indexing means includes a linear element attached to the tool platform for relative movement with respect to the takeup spool during reciprocation of the needle, the linear element being placed in tangential engagement with the takeup spool to urge spool rotation during reciprocation of the needle.

7. The improvement of claim 6 wherein:

the indexing means further includes means preventing rotation of the takeup spool in one direction and wherein the linear element is frictionally engaged with the takeup spool to allow sliding movement of the element over the spool when spool rotation is prevented.

8. The improvement of claim 7 further including means for resiliently urging the linear element into frictional engagement with the takeup spool.

9. The improvement of claim 1 further including lockout means responsive to the needle plunger movement relative to the tool platform for preventing relative movement of the tool and sheet material when the plunger and needle are out of a rest position in which the needle is held by the plunger out of contact with the sheet material.

* * * * *